United States Patent [19]

Gillespie

[11] Patent Number: 4,552,692

[45] Date of Patent: Nov. 12, 1985

[54] CONCENTRATED COMPOSITION FOR CLEANING RUGS AND CARPETS

[76] Inventor: Thomas W. Gillespie, 16528 Foothill Dr., Tampa, Fla. 33624

[21] Appl. No.: 618,751

[22] Filed: Feb. 21, 1984

Related U.S. Application Data

[63] Continuation of Ser. No. 337,924, Jan. 8, 1982, abandoned, which is a continuation of Ser. No. 125,134, Feb. 27, 1980, abandoned.

[51] Int. Cl.[4] ..... C11D 3/065; C11D 1/22

[52] U.S. Cl. ..... 252/528; 252/89.1; 252/173; 252/171; 252/174.18; 252/174.19; 252/174.23; 252/525; 252/531; 252/534; 252/539

[58] Field of Search ..... 252/88, 89.1, 135, 136, 252/139, 170, 171, 173, 174.13, 174.21, 174.19, 174.23, 528, 547, 534, 531, 539, 174.18

[56] References Cited

U.S. PATENT DOCUMENTS

| | | | |
|---|---|---|---|
| 3,418,243 | 12/1968 | Hoxie | 252/154 |
| 3,736,259 | 5/1973 | Buck et al. | 252/139 X |
| 4,090,974 | 5/1978 | Morganson | 252/135 |
| 4,094,701 | 6/1978 | Fekete | 132/2 |
| 4,096,084 | 6/1978 | Thomsen et al. | 252/173 |
| 4,124,542 | 7/1978 | Devine | 252/546 |
| 4,219,333 | 8/1980 | Harris | 8/137 |
| 4,308,047 | 12/1981 | Holland | 71/73 |

FOREIGN PATENT DOCUMENTS 2240287 4/1975 France .

*Primary Examiner*—Prince E. Willis

*Attorney, Agent, or Firm*—Frijouf, Rust & Pyle

[57] ABSTRACT

A multi-component composition and the process for using same to clean substantially every type of carpet found in residential and commercial use is disclosed. The process employs electrostatic action to remove emulsified soil from the rug surface, said soil having been loosened by the application of the cleaning solution of this invention.

1 Claim, 7 Drawing Figures

CONCENTRATED COMPOSITION FOR CLEANING RUGS AND CARPETS

This is a continuation of application Ser. No. 337,924 filed Jan. 8, 1982 abandoned which is a continuation of application Ser. No. 125,134 filed Feb. 27, 1980 and now abandoned.

BACKGROUND OF THE INVENTION

For as long as man has utilized floor coverings in his dwelling house, he has had the problem of maintaining the floor coverings in a clean condition. Whereas, carpets have been improved, changed and modified over the course of centuries, the problem of preventing the rugs from spotting and soiling has never been overcome. Accordingly, it has always been necessary to clean rugs and carpets by one of many processes available to the rug or carpet owner. As late as the 1940's and '50's, it was necessary to hand scrub home carpets, utilizing mild detergent solutions. As technology improved, devices were found for applying soap solutions and detergent solutions to rugs.

A distinct improvement over earlier processes was the use of steam to lift and clean the dirt from the carpet or rug. The various steam cleaning processes, while indeed beneficial are relatively time consuming and require direct hook-up to a source of steam, and thus, can only be utilized in low level buildings, as it is generally either impractical or unsafe to run steam lines from the source of steam up many flights of stairs to either apartments or high level offices in multi-story buildings. Another drawback with the use of steam for cleaning carpets, is the fact that a great deal of humidity is created in the cleansed rooms. A common corrective measure comprises maintaining heat in the rooms during periods of non-occupancy, but this extra heating is wasteful of energy resources. Another problem with excess humidity, is the potential of damage to various types of items in the cleansed area. Thus, care should be taken with rare books and other items that could suffer moisture damage.

As technology continued to advance, automatic applicating machines for detergents were invented, but such methods of rug cleaning suffer from the face that residual detergent tends to gather and remain in the interstices of the fibers of the rug; if not removed, this residual detergent may cause undesirable discoloration of the carpet.

The instant process is an improvement on both the machine shampoo and the steam cleaning processes for the cleansing of rugs and carpets. The instant technique employs a new composition to clean rugs and carpets by electrostatic action in significantly shorter periods of time than are required by the use of prior art techniques.

SUMMARY OF THE INVENTION

The present invention employs a multi-component composition in which each ingredient is used to achieve a certain desired result such as cleaning, stabilization, dissolving, brightening, and the like. Preferably, this new composition is employed in conjunction with the process of this invention in order to achieve the optimum results.

Therefore, it is an object of this invention to provide a composition and a process which overcome the aforementioned inadequacies of the prior art and provide improvements which are significant contributions to the advancement of the pertinent art.

Another object of the invention is to provide a novel rug cleaning solution containing many components. It is another object of the invention to provie a rug cleaning which is applied under pressure to the rug or carpet surface.

Another object of the invention is to provide a rug cleaning solution which contains carbonic acid in conjunction with other components.

A further object is to provide a composition which can be used for both cleaning and spotting of rug surfaces.

Still another object is to provide a multi-component composition which is applied under pressure to carpeting and which contains carbonic acid, for the loosening of soil, the composition being volatile and removable from the rug surface by electrostatic action.

One other object is to provide a rug cleaning technique wherein a solution is buffed from the rug surface preferably by rotary action which creates an electrostatic charge to remove soil from rug fibers.

The invention accordingly comprises the several steps detailed hereinafter and the order of such steps with respect to each other, as well as the composition detailed in the following disclosure.

For a fuller understanding of the nature and objects of the invention, reference should be had to the following detailed description, taken in conjunction with the accompanying drawings.

DESCRIPTION OF THE PREFERRED EMBODIMENT

Figure 6:
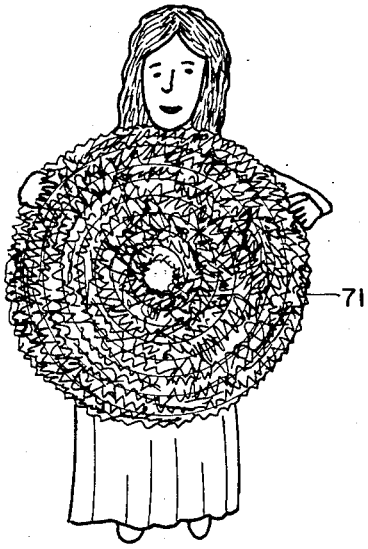
FIG. 6 illustrates a typical pad which is used to buff the rug surface in accordance with the invention.

The process of this invention, requires the preparation of a 10 which composition is applied to the rug surface. The composition 10 is a cleaning solution which is applied to the rug after the rug has been prevacuumed to remove surface soil. In areas that are heavily spotted, such as from food stuffs or staining material such as ink or fruit and the like, large doses of the solution should be applied. Surface hardened staining materials such as chewing gum, syrup for pancakes, chocolate sauce and the like, should be scored vertically by a cutting edge such as a pocket knife to ease the removal of the staining material by the contact with the buffing pad. A short dwell time is permitted for the multi-component composition 10 to react with the dirt to loosen and emulsify same. The rug is then buffed with a pad containing cotton as illustrated in FIG. 6, which will be described in detail below. If necessary, any of the cleansing steps may be carried out and then followed by a re-buffing of the extremely soiled area. It is rare that step 57, the repeat of the basic cleansing processes, will be required.

CLEANING COMPOSITION

The cleaning composition 10 of this invention comprises several components designed to remove all types of soil. The composition employs a combination of at least 10 ingredients in addition to carbonic acid as the delivery vehicle.

The first ingredient is designated the main detergent and is employed in a range of 3–7% of the composition to be effective. All percentages set forth herein are by volume based on one gallon of cleaning solution, namely 128 ounces (fluid). The preferred embodiment employs sodium alkylnaphthalene as the main detergent. The alkali fatty acid sulfate known as sodium lauryl sulfate is acceptable as a main detergent in an alternative embodiment.

A second detergent, milder than the main detergent and known as the mild detergent, is employed in conjunction with the main detergent. The mild detergents are employed in the range of 4–8% to be effective. The preferred embodiment employs a sodium "higher alkyl" olefin sulfate in the class designated as the sodium $C_{14}$–$C_{16}$ olefin sulfates. In an alternative embodiment, as "lower alkyl" ingredient in the class designated as the $C_1$–$C_4$ alkyl benzene sulfonates is used as the mild detergent. It has been found that the combination of the main detergent and the mild detergent tends to reduce the tendency of the carpet to stiffen as it dries.

The third ingredient is a stabilizer that serves as an anti-foaming agent to prevent the composition of this invention from over foaming. The stabilizer is selected from the group consisting of cocoamide, lauramide, and diethanolamine, and it is employed in the composition within the range of one to three percent to be effective. The anti-foam agent tends to soften the water and to reduce basic ions in the water utilized for the preparation of the concentrate, prior to the addition of the carbonic acid delivery agent.

The fourth ingredient comprises a combination cleaner and water softener. It is used to soften the water by reducing the basic ions present in the water employed for preparation of the concentrate. The term concentrate denotes the solution of cleaning agents, prior to the carbonation step, i.e. prior to the addition of carbonic acid. This fourth reagent is added in the range of 8 to 12% to be effective and is selected from the group consisting of tetrapotassium pyrophosphate and tetrasodium pyrophosphate.

The fifth ingredient used to dissolve and loosen potentially sticky substances such as chewing gum, pancake syrup, chocolate sauce and the like comprises a lower alkyl alcohol such as methanol, ethanol, butanol, propanol and isopropanol.

The sixth ingredient is a suitable low foam surfactant such as non-ionic polyglycol, employed within the range of 2–10% to be effective. This surfactant is employed to solidify the dirt such that it can be taken up by the buffing pad. Such action negates the need to vacuum the rug upon the completion of the buffing step of the process. When such ingredient was omitted from the composition, the desired level of the cleaning was not achievable without a second vacuuming step.

An optical brightener is added as the seventh ingredient of composition 10, to give visual high lights to the clean rug or carpet. The optical brightener is added within the range of 0.05 to 0.2% to be effective and is preferably either Hittamine Arctic White, a product of Ciba-Geigy or Tinopol, also available in the marketplace. Other compatible optical brighteners may also be employed.

In order to thicken the concentrate, i.e. the solution prior to the carbonation step, a thickening agent is added in an amount to create a liquid slightly more viscus than water. This renders the concentrate easier to handle. A thickening agent compatible with the other components is employed within the range of 0.05–0.2%. The thickening agent is preferably selected from the group consisting of carboxy methyl cellulose and sodium carboxy methyl cellulose, although other thickening agents may also be used.

As has been indicated before, the process of the instant invention employs electrostatic attraction of the dirt to the buffing pad. Accordingly, to achieve same, it has been found beneficial to include one or more polymers that act as electrostatic conductors, often called conductants. In the preferred embodiment, the conductant is at least one compound in the group consisting of aminoethylcrylate-phosphate and oblique acrylate copolymer. These conductants also serve as disinfectants and may be employed either alone or in combination within the range of 0.5% to 1.5% by volume to be effective. Better results are seen to occur when both of the named compounds are used in combination.

The use of a conductant ingredient minimizes the amount of physical "working" of the carpet fibers (in the buffing step) which is required to produce the desired degree of cleaning.

Other usable electrostatic conductants include quaternary amonium chloride compounds such as alkyl dimethylbenzyl ammonium chloride. Other suitable components may also be employed. When aminoethylacrylate-phosphate and oblique acrylate copolymer are employed as conductants it has been found that they may be employed within the relative ratios of 2:0 to 0:2, thus illustrating that either alone or in combination, they may be employable herein. The preferred relative ratio is 1:1.

The tenth component is tannin, which is employed within the range of 2 to 6%, as a stain remover of urine, tea, coffee, berry stains and other common household and business stains of a non-oil nature.

Optionally, an eleventh ingredient which is a coloring material, may be added for cosmetic purposes, in the quantity of about 1 to 2 drops per gallon of concentration prior to dilution. Any other compatible dye may also be employed for similar purposes. It has been found that the minor concentration of coloring matter, mainly on the order of about 0.008%, gives rise to a product which appears to have cleansing capabilities, as opposed to being colorless.

Of course, any other suitable dye or coloring matter may be employed in similar quantities so long as it is not detrimental to the desired effect, namely cleaning of the carpet or rug, and so long as no visible indication of the dye is left on the rug surface.

Optionally, sodium or potassium silicate may be added in minor amounts as an additional thickening agent, in addition to the cellulosic materials previously mentioned as the eighth component. The advantage of employing sodium or potassium silicate as a thickener, in small quantities such as in the neighborhood of 0.02%, is the fact that the cost of this reagent is significantly less than that of the components previously mentioned.

Component 13 is a deodorant and this is employed in the range of about 1 to 3% by volume, of the gallon of concentrate. One deodorant that I have found to be quite satisfactory, is Chex odor killer, a liquid manufactured by Ultra Labs of Santa Clara, California.

When all of these ingredients are added together, sufficient water, in addition to the original water used to blend the two surfactants is added to give a total volume of 1 gallon. The additional water will vary from about 8 to 10 fluid ounces of water.

The preparation of the composition requires the placing of approximately one half gallon of water in the mixing vessel, followed by the addition of compensates 1 to 2. After these are stirred slightly, the remaining components are added, followed by the dilution to the full gallon. Mildly agitate all of the components together to create a homogeneous composition. No heat or pressure is required. The concentrate may be stored at least 6 months without any detrimental effect.

Figure 7:
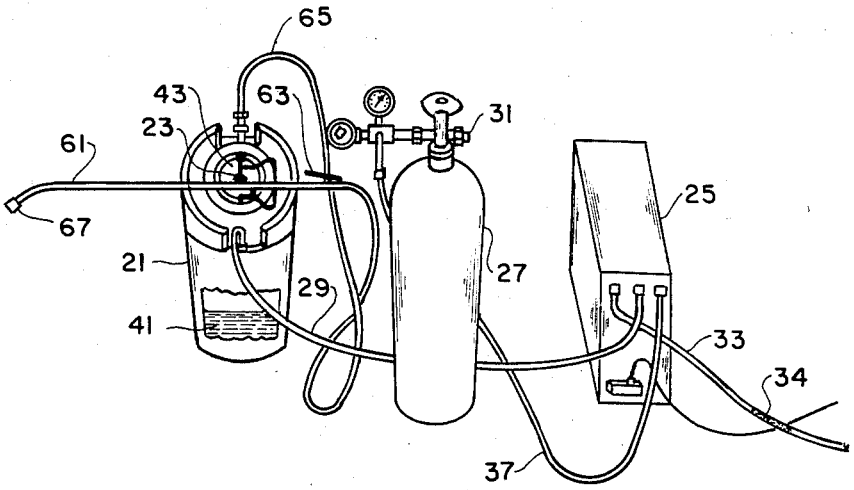
FIG. 7 is a perspective view of equipment employable to carbonate the solution employed in the process of this invention.

When it is desired to employ the concentrate for rug cleaning, the concentrate is poured into a five gallon pressurized containers such as a container shown in FIG. 7 herein. Three gallons of carbonic acid are added from the equipment shown in FIG. 7 to be described in more detail below. This gives rise to a volume of about 4 gallons in the 5 gallon container with the balance of the volume being maintained for the purpose of pressurization. The carbon dioxide is added under 120 psi of pressure, from a container having a blow off valve, capable of blowing off about 140 psi. This provides a sufficient safety factor for the pressurized vessel 21.

Details on the transformation of the concentrate to the cleaning solution will be set forth below.

In addition to those components named as being suitable for the sixth component, it has also been found that polyethylene glycol 3,000 and other similar polymers, may also be employed for the same purpose.

While the preferred embodiment employs 3 gallons of carbonic acid per gallon of concentrate to prepare the solution, a range of 2 to 5 gallons of acid may actually be employed. The concentric of carbonic acid prepared and used may range between a 0.2% and 2.0% acidic solution with a 1% solution being preferred.

PREPARATION OF CLEANING SOLUTION

Concentrate 41 is poured into a pressurized vessel 21. The cap 43 of the vessel 21 is suitably tightened as by screwing it or latching it down as the case may be, depending upon the brand of vessel employed. Carbonator 25 is connected via line 37, in fluid communication with carbon dioxide ($CO_2$) tank 27, and to water line 33 such that both flow into carbonator 25. Carbonator 25 is further linked in fluid communication to pressurized vessel 21 from the output line 29 by the carbonator 25 to the pressure vessel 21. Reference is again made to FIG. 7, which shows such hookup. When the regulator valve 31 is opened to control the pressurized flow of carbon dioxide 28 from tank 27 into the carbonator 25 and the water 34 from water line 33 is turned on, both carbon dioxide gas and water will flow into the carbonator. The gas will dissolve in the water as is classically known to form carbonic acid, which exits through the output line 37 from carbonator 25. The carbonic acid is pumped in under pressure into the pressurized vessel 21 at a pressure of about 120 psi. The blow off pressure of such a pressurized can which is usually of 5 to 10 gallon capacity, is normally 140 psi. This allows an adequate safety factor.

Suitable pressurized vessels for the storage of the carbonated concentrate now designated cleaning solution, or cleaning composition 11, may be obtained from any source of soda water syrups. Thus, the local Pepsi-Cola or Coca-Cola distributor or restaurant supply house, can supply suitable vessels well known in the art for the preparation and storage of soda water.

It is to be seen that none of the apparatuses employed in the carbonation of the concentrate to prepare the cleaning solution of this invention, form part of the invention. Each apparatus is readily available in the marketplace from a plurality of vendors. Thus, only the process of carbonating the concentrate to form the cleaning solution constitutes part of my invention.

It is to be seen that the carbonation step forms a very important part of the process of my invention in that the carbonic acid serves as the delivery vehicle for the concentrate containing the plurality of ingredients previously described. The concentrate comprising the plurality of ingredients, is mixed with carbonic acid to form the cleaning solution of this invention, designated 81 herein.

In FIG. 7, the concentrate 41 is seen to be present in the cutaway portion of the bottom of vessel 21. Optional gauges are also seen.

Figure 3:
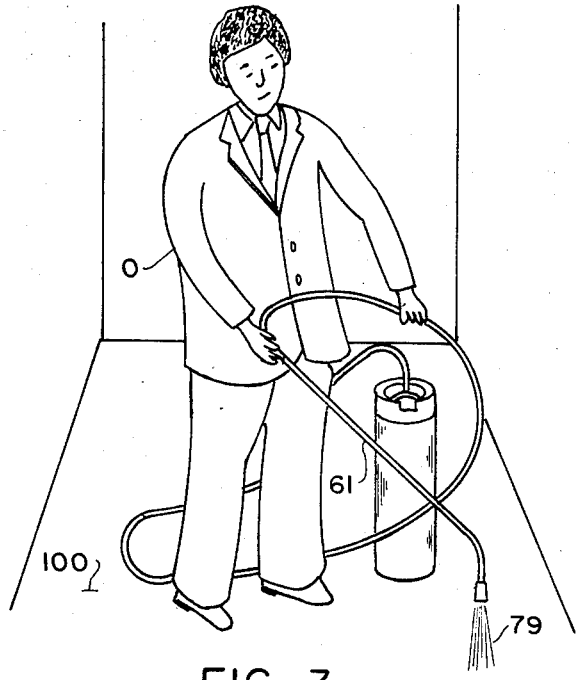
FIG. 3 illustrates the application of the cleaning solution.
Figure 4:
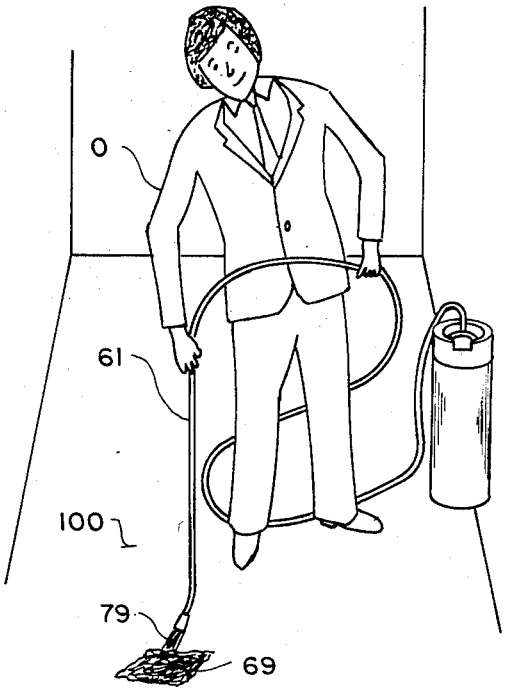
FIG. 4 illustrates the close application of the cleaning solution of this invention for spotting.

This figure also illustrates the connection of wand 61 to the output line 65, the action of which wand 61 is actuated by trigger 63, such that the spray 79 is discharged through nozzle 67. The use of the wand 61 and trigger 63 is illustrated in FIGS. 3 and 4 wherein spray 79 is seen exiting from the nozzle 67. The spray 79 has formed a spot of froth 69 on carpet 100, in FIG. 4, due to a shorter nozzle to carpet distance.

CLEANING PROCESS

Figure 1:
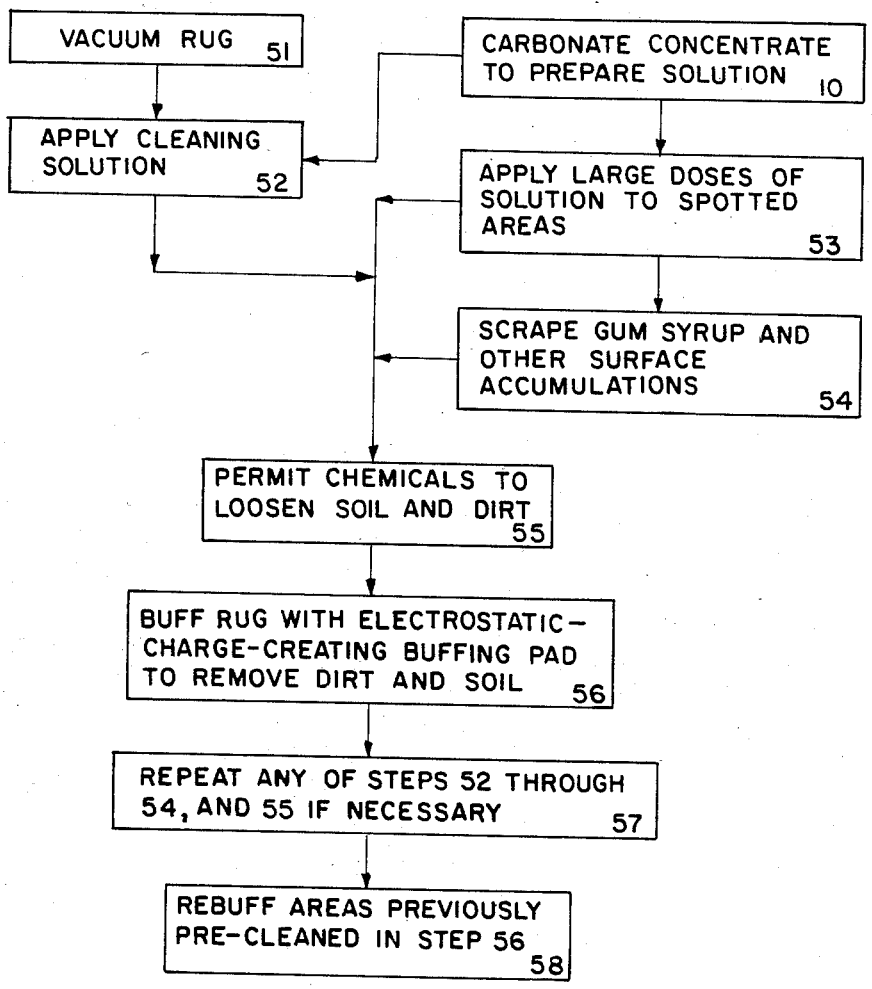
FIG. 1 is a flow chart illustrating the steps involved in the process of the instant invention.

FIG. 1 is a flow chart illustrating all of the steps involved in the process of this invention. The concentrate not shown in the figure, is first carbonated at box 10 and held for useage at the proper time, namely box 52.

Figure 2:
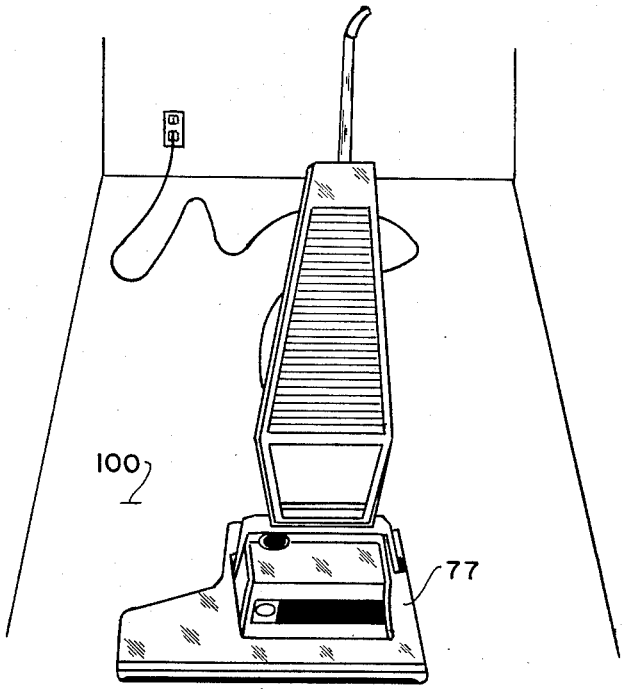
FIG. 2 illustrates one step in the process of this invention.

In the process of this invention, rug 100 is first vacuumed by any conventional vacuum unit known to the art. This is to remove any surface dirt that is or has accumulated in the carpet. The suction of the vacuum cleaner also tends to loosen certain types of dirt that are found in and on the carpet fibers. See FIG. 2, where the vacuum is depicted.

FIG. 3 depicts the spraying of the carpet. Here the operator O is seen squeezing the trigger 63 of wand 61, such that liquid exits through nozzle 67 of wand 61. The nozzle is held a distance approximately 20 to 24 inches from the rug surface. Reference being made to box 52 of FIG. 1 as well. A generally circular motion, or other convenient motion to cover the territory, usually an area of about 6 to 12 square feet, is sprayed at any one time. It is preferred that larger areas not be sprayed as the solution emanating from pressure vessel 21, though of reasonably cool temperature, namely on the order of about 40 to 50 degrees, due to the pressure of the carbonic acid of the pressure, tends to volatilize quite quickly.

FIG. 4 illustrates the spotting of a carpet as can be shown by the presence of the white froth 69, which froth consists of the same composition as used in the general spraying, the only difference being that the composition is applied at a distance from the wand to the rug surface of about 6 to 8 inches. This action tends to concentrate the solution in a small area to aid in the removal of stains. Note the relative position of the operator "O", in FIG. 4, wherein he tends to lean over rather than stand up, in order to achieve the desired nozzle to rug surface distance. Obviously it is seen that there is no criticality in either of the above mentioned nozzle to rug distances, they are recited merely for the purpose of comparison and for ease of operation of the operator. FIG. 4 corresponds to the step designated as step 53 in FIG. 1. If surface accumulations are present, such as chewing gum, chocolate syrup and other congeal substances, it is preferable to score the surfaces of such accumulated materials to enable the take up by the buffing action, to be described, to be carried out more successfully. By scoring the accumulations with a kitchen knife or pocket knife, the congealed masses are broken up into four segments and are thus rendered easier to take up.

It is to be understood that the steps shown in FIG. 3 deliver the cleaning solution as a very fine mist to the rug surface, as a pressure of approximately 120 to 125 psi. In order to avoid what I call a hydroplaning effect of the carpet of the running of the buffer thereupon, as will be described, I have optimized the amount of cleaning solution to be delivered to any preselected square foot area of carpet. If the carpet is too wet, it is found that the buffer slides over it and as such, it will not pick up the dirt. On the other hand, I have found that 4 gallons of the cleaning solution of this invention will clean approximately 2,000 square feet of carpet (it being understood that these 4 gallons comprise one gallon of concentrate diluted with 3 gallons of carbonic acid).

Figure 5:
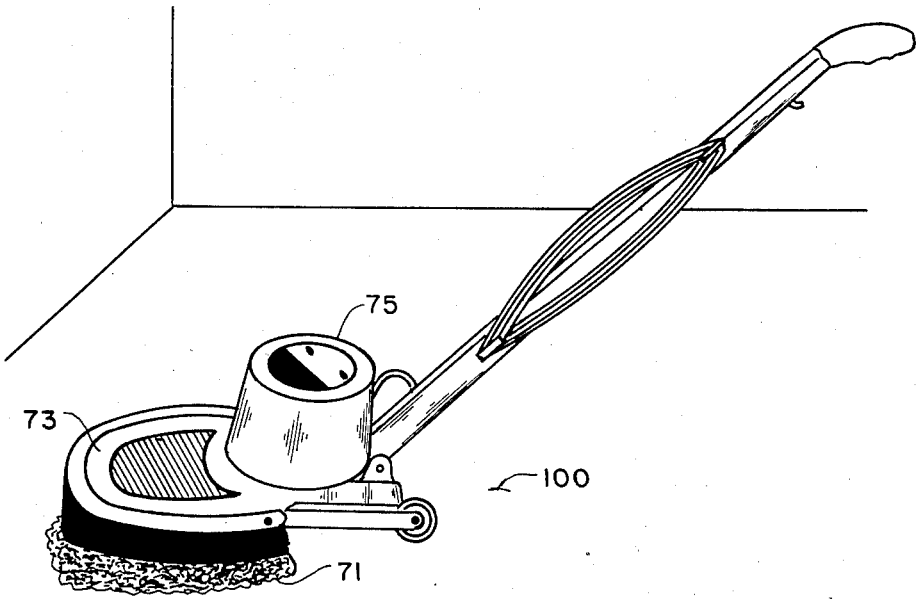
FIG. 5 illustrates the buffer for the rug surface in accordance with the invention.

Turning now to FIG. 5, the rug surface is buffed, using a low speed commercial buffer. The motor speed may vary any where from about 225 to 350 rpm. One commercial embodiment that I have employed operates as 250 rpm. A suitable machine, 73 is manufactured by Advance and it is designated model 17S and utilizes a 1 horse power motor. The rug surface is buffed with a circular pad as shown in FIG. 6, with pad 71 being replaced after having been first turned over approximately every 15 to 20 feet of rug surface. I have found that I utilize approximately four to five pads, both sides, for the average house's rug surfaces. It is important to the process of the instant invention, that the pad be one capable of generating static electricity. I have found, therefore, that cotton pads and preferably cotton and rayon mixed fiber pads perform the desired task satisfactorily. The action of the buffing operates in accordance with a Coulomb's law, in that static electricity is generated by the impingement of the fibers of the buffing pad against the moist rug surface. The electricity attracts the previously loosened dirt and other foreign particles in the carpet to the pad. When the pad becomes saturated with solution being taken up from the rug, it is turned over. It is within the skill of the art to determine when the pad should be turned over as well as when it should be replaced.

It is readily recognized in the art that one does not see dirt, but the results of dirt. Soil is readily visible, such as from the garden as is stain material such as grape juice and the like. All of these are dissolved by the chemical agents present to be taken up by the electrostatic action.

While box 55 of FIG. 1 indicates that the chemicals of the solutions should be permitted to loosen soil and dirt, it should be recognized that minimum dwell time is required for the process of this invention. That is, the solution may be sprayed on as previously discussed and then substantially, immediately the dirt may be removed by the buffing action. A typical buffing pad 71 is shown in FIG. 6. No criticality lies in the nature of the buffing pad, provided that the pad is capable of generating static electricity.

I have found that the process of the instant invention can be utilized with all types of carpet, namely plush, shag, cut pile, etc., and works on all fibers such as wool, olefin, nylon, polyester and the like, but it will not work on cotton fibers. It is theorized that the presence of similar fiber in the rug and the pad, tends to neutralize the electrostatic action to prevent the desired level of cleaning action.

Buffing pads 71 shown in FIG. 6 are available from Seeco of Cleveland, Tennessee, as well as other suppliers. While no criticality is claimed for the use of the brand named machine above, the construction of the machine which is shown in the figure, has motor 75 offset toward the rear, permitting entry of the apparatus beneath chairs, tables, couches and the like, to permit cleaning beneath same without the necessity of actually removing the furniture if such is not desired or is physically impossible.

The drying time required will vary not only with the amount of buffing, due to the presence of concentrated solution of this invention, but also with the nature of the fiber and the height of the rug. Thus, a short nap will dry faster than a shag rug. On the average, it is seen that in non-spot cleaned areas, the average drying time assuming room temperature conditions, will be approximately 45 minutes to two hours. Since the rug surface is not saturated with liquid, one may walk upon the rug surface just as soon as the buffing operation has been completed. This is especially important in restaurants as restaurants require the use of as many seats as possible at all times. This is to be contrasted with the sometimes overnight drying time required for prior art steam cleaning processes which utilize up to 10 times as much liquid per square foot of carpet cleaned.

Returning momentarily to FIG. 1, it is seen that box 56 which requires the buffing action, has just been discussed. Though rarely necessary, one may choose for extremely high traffic areas or extremely dirty, very light carpet colors, to repeat the steps shown in boxes 52, 53 and optionally 54, is such materials are present, and 55, followed by a rebuffing as discussed with respect to box 56, said rebuffing step constituting box 58.

In FIG. 6, the size of a 19" pad as generally employed with the buffing machine of FIG. 5 is shown. It is contrasted in size with a 6 year old girl who is holding said pad. While larger diameter pads, as well as smaller diameter pads are available for machines of other manufacturers, this size which is readily available has proved quite successful in operation.

In the preparation of the cleaning solution designated 81, from concentrate 41, I have employed carbonic acid as the dilutant and as a carrier. I have specifically chosen carbonic acid, for several reasons. Firstly, it is easily made from a readily available source, namely carbon dioxide. The entrained $CO_2$ bubbles tend to aid in the evaporation of the solution 81, after application. In addition, carbonic acid is quite safe for children, animals, and of course, the rug fibers. An added benefit of the carbonic acid is that the pH is changed slightly toward the acid side, a fact which apparently aids the multiple component composition in the removal of soil. By contrast, I found that other gasses such as compressed air with bubbles entrained in water do not give as good a result. While no assertion is made, it is highly possible that the $H_2CO_3$ releases $CO_2$ which in turn can complex in some fashion, with one or more of the several ingredients found in the concentrate.

As an alternative to the use of $CO_2$, to reduce the pH and to act as a delivery agent under pressure, one could substitute sodium sulfate, and employ pressurized nitrogen or pressurized air to dispense the cleaning composition of this invention. However, due to ease of utilization and the product being readily available, $CO_2$ is preferred.

It is to be pointed out that the pH of the concentrate before the addition of the carbonic acid is 8.0 to 8.5 while after the addition of the carbonic acid, it is reduced to about 7.0 or slightly less.

It is seen that I have exposed herein, a new and useful multi-component composition which is designated a concentrate for a cleaning solution for carpets and rugs. The cleaning solution is prepared by the addition of carbonic acid to the concentrate to yield a useable end product. While the solution has been disclosed as being deliverable merely by the use of the pressurized dispenser wherein the carbonic acid acts as the delivery agent, it is also to be seen that such composition, including the delivery agent carbonic acid, may be placed in small pressurized household type cans wherein fluorocarbons or other gasses serve as the propellent to exhaust the composition of this invention from the dispenser. Such small cans of this product would be ideal for the home owner for cleaning spotted areas of home carpets.

Another major benefit of utilizing the process of this invention in conjunction with the disclosed composition, is the fact that rugs, both commercial and residential, can be cleaned at a significantly lower cost than the same rug could be cleaned by standard shampoo techniques. Thus, commercial carpet can be cleaned profitably, at a cost of 50 to 60% of the cost of a quality shampoo treatment for such carpet. To do so, one gallon of concentrate is mixed with three gallons of carbonic acid in a five gallon container. One operator can clean an average restaurant in about one hour. A home of approximately 2,000 square feet, can have its carpets cleaned in less than one hour. One big advantage to the user is that it is unnecessary to vacate the for drying purposes due to the excess humidity normally associated with steam cleaning.

Although this invention has been described in its preferred form with a certain degree of particularity, it is understood that the present disclosure of the preferred form has been made only by way of example and that numerous changes in the details of the preferred embodiment may be resorted to without departing from the spirit and scope of the invention.

I claim:

1. A concentrated composition for use in cleaning rugs and carpets comprising an effective amount of each of:

a. a first detergent soluble in water, said first detergent being selected from the group consisting of sodium alkylnaphthalene and sodium lauryl sulfate wherein said first detergent is used in a concentration of 3% to 7% by volume;

b. a second detergent milder than said first detergent, said second detergent being selected from the group consisting of a sodium $C_{14}$–$C_{16}$ olefin sulfate and a lower alkyl benzene sulfonate wherein said second detergent is used in a concentration of 4% to 8% by volume;

c. an anti-foam agent selected from the group consisting of cocoamide and lauramide wherein said anti-foam agent is used in a concentration of 1% to 3% by volume;

d. a water softener selected from the group consisting of tetrapotassium pyrophosphate and tetrasodium pyrophosphate wherein said water softener is used in a concentration of 8% to 12% by volume;

e. at least one lower alkanol in an amount sufficient to dissolve and loosen potentially sticky substances such as chewing gum, pancake syrup and chocolate sauce;

f. a low foam surfactant consisting of non-ionic polyglycol wherein said low foam surfactant is used in a concentration of 2% to 10% by volume;

g. an optical brightener wherein said optical brightener is used in a concentration of 0.05% to 0.2% by volume;

h. at least one thickening agent wherein said thickening agent is used in a concentration of 0.05% to 0.2% by volume;

i. at least one electrostatic conductant selected form the group consisting of aminoethylacrylate-phosphate, oblique acrylate copolymer and alkyl dimethylbenzyl ammonium chloride wherein said electrostatic conductant is used in a concentration of 0.5% to 1.5% by volume;

j. tannin in a concentration of 2% to 6% by volume; and k. water in an amount sufficient to make a total volume of 1 gallon of the concentrated composition.

* * * * *